US008245777B2

(12) United States Patent
Garner

(10) Patent No.: US 8,245,777 B2
(45) Date of Patent: Aug. 21, 2012

(54) TUBING CENTRALIZER

(76) Inventor: Stephen Randall Garner, Odessa, TX (US)

( * ) Notice: Subject to any disclaimer, the term of this patent is extended or adjusted under 35 U.S.C. 154(b) by 344 days.

(21) Appl. No.: 12/460,791

(22) Filed: Jul. 24, 2009

(65) Prior Publication Data

US 2010/0018698 A1 Jan. 28, 2010

Related U.S. Application Data

(60) Provisional application No. 61/137,016, filed on Jul. 25, 2008.

(51) Int. Cl.
*E21B 17/10* (2006.01)

(52) U.S. Cl. ..... 166/213; 166/241.4; 175/325.5

(58) Field of Classification Search ..... 166/241.1, 166/213; 175/325.5; 81/176.2, 177.2; 29/896.9–896.93
See application file for complete search history.

(56) References Cited

U.S. PATENT DOCUMENTS 3,343,608 A * 9/1967 Solum ..... 166/241.7
4,688,636 A 8/1987 Hennessey
4,938,299 A 7/1990 Jelsma
4,960,173 A 10/1990 Cognevich et al.
5,261,488 A 11/1993 Gullet et al.
5,358,039 A 10/1994 Fordham
5,575,333 A 11/1996 Lirette et al.
5,697,768 A 12/1997 Mills
5,758,723 A 6/1998 Saucier et al.
5,782,305 A 7/1998 Hicks
5,937,948 A * 8/1999 Robbins, III ..... 166/380
5,979,550 A 11/1999 Tessier
5,992,525 A 11/1999 Williamson et al.
6,102,118 A 8/2000 Moore
6,209,638 B1 * 4/2001 Mikolajczyk ..... 166/241.1
6,367,556 B1 * 4/2002 Moore ..... 166/378
6,435,275 B1 8/2002 Kirk et al.
6,453,998 B1 9/2002 Reeve
6,457,519 B1 10/2002 Buytaert
6,464,013 B2 10/2002 Bystedt
6,513,223 B1 2/2003 Angman et al.
6,533,034 B1 3/2003 Barger
6,564,870 B1 5/2003 Grigsby et al.
6,585,052 B2 7/2003 Angman et al.
6,637,511 B2 10/2003 Linaker
6,725,939 B2 4/2004 Richard
6,845,816 B2 1/2005 Kirk et al.
7,048,064 B1 5/2006 Smith
7,071,697 B2 7/2006 Rioufol et al.
7,140,432 B2 11/2006 Gremillion
2002/0139538 A1 * 10/2002 Young et al. ..... 166/380
2003/0106719 A1 6/2003 Herrera
2003/0150611 A1 8/2003 Buytaert
2003/0164236 A1 9/2003 Thornton

* cited by examiner

*Primary Examiner* — Shane Bomar
*Assistant Examiner* — Catherine Loikith
(74) *Attorney, Agent, or Firm* — Davis Miles McGuire Gardner PLLC; Gregory S. Donahue

(57) ABSTRACT

A tubing centralizing apparatus has a centralizer body including opposing end portions, a central passage extending through the opposing end portions, and a plurality of apertures extending therethrough between its exterior side surface and the central passage. The apertures are uniformly spaced about a longitudinal axis of the central passage. Bow springs are mounted on the exterior side surface of the centralizer body such that a central portion of each one of the bow springs is bowed away from the centralizer body. The tubing sub is slideably positioned within the central passage of the centralizer body. One of the tubing joint collars is attached to each end portion of the tubing sub. The tubing joint collars and the centralizer body are jointly configured such that the tubing joint collars engage the centralizer body for constraining the tubing sub within the central passage of the centralizer body.

18 Claims, 1 Drawing Sheet

TUBING CENTRALIZER

CROSS REFERENCE TO RELATED APPLICATIONS

This patent application claims priority from U.S. Provisional Patent Application having Ser. No. 61/137,016 filed on Jul. 25, 2008 entitled "Garner Production Tubing Centralizer", having a common applicant herewith and being incorporated herein in its entirety by reference.

FIELD OF THE DISCLOSURE

The disclosures made herein relate generally to oil field equipment and, more particularly, to centralizers for pipes, tubing and casings used in oil field operations.

BACKGROUND

In the context of oil field applications, a centralizer is a device used to provide space between an interior surface of a casing (e.g., a tube or pipe) and an exterior surface of a tube that is positioned within the casing. The centralizer encompasses a segment of the tube and is configured or shaped to uniformly maintain space between the casing and the tube. Thus, centralizers are used to center one tubular member (i.e., an inner tubular member) inside a cylindrical bore of an outer body (e.g., an outside tubular member, a borehole or the like).

Typically, a centralizer includes a central bore or passage through which the inner tubular member passes and a plurality of protruding members such as, for example, a bow spring, that extends outwardly into engagement with a wall defining the cylindrical bore of the outer body in which the inner tubular member resides. The protruding members are typically uniformly spaced around a perimeter of the inner tubular member so as to center the centralizer and inner tubular member within the cylindrical bore of the outer body in which the inner tubular member resides.

Various type and configurations of centralizers are well known in the oil field industry. However, a centralizer that is specifically configured for use with production tubing within a casing and that overcomes shortcomings associated with use of known centralizers in such production tubing application would be advantageous, desirable and useful.

SUMMARY OF THE DISCLOSURE

A tubing centralizer apparatus configured in accordance with the present invention centers an inner tubular member within a bore (e.g., cylindrical bore) of an outer body such as an outer tubular member. More specifically, on production pumping wells, a tubing centralizer apparatus in accordance with the present invention centers production tubing that is swinging free below a tubing anchor within a casing. Such centralizing reduces, if not eliminates, the potential for perforations in the tubing and/or casing as well as reduces rod wear. Advantageously, a tubing centralizer apparatus in accordance with the present invention is configured for being retrievable from within the outer body (e.g., a casing) and for being refurbished.

In one embodiment of the present invention, a tubing centralizing apparatus comprises a centralizer body, a plurality of resilient members, a tubing sub, and a first tubing joint collar. The centralizer body has opposing end portions and a central passage extending through the opposing end portions. The centralizer body includes at least one aperture extending therethrough between an exterior side surface thereof and the central passage thereof. The plurality of resilient members is mounted on the centralizer body. Each one of the resilient members is in the form of an elongated strap having opposing end portions. A first one of the end portions of each one of the resilient members is attached to the centralizer body adjacent one of the end portions of the centralizer body in a manner whereby a second end portion thereof extends toward the other one of the end portions of the centralizer body. A central portion of each one of the resilient members is spring biased away from the centralizer body. The tubing sub is slideably positioned within the central passage of the centralizer body and having opposing end portions. The first tubing joint collar is attached to a first one of the end portions of the tubing sub. The first tubing joint collar and the centralizer body are jointly configured for precluding the first tubing joint collar from passing though central passage.

In another embodiment of the present invention, a tubing centralizing apparatus comprises a centralizer body, a plurality of bow springs, a tubing sub, and joint collars. The centralizer body has opposing end portions and a central passage extending through the opposing end portions. The centralizer body includes a plurality of apertures extending therethrough between an exterior side surface thereof and the central passage thereof. Each one of the apertures is an elongated aperture that extends lengthwise between the opposing end portions of the centralizer body. The apertures are uniformly spaced about a longitudinal axis of the central passage in a manner providing a symmetric aperture pattern in the centralizer body. The bow springs are mounted on the centralizer body. A first end portion of each one of the bow springs is attached to the centralizer body adjacent a first end one of the portions thereof and a second end portion of each one of the bow springs is attached to the centralizer body adjacent a second one of the end portions thereof such that a central portion of each one of the bow springs is bowed away from the centralizer body. The bow springs are uniformly spaced about the longitudinal axis of the central passage in a manner providing a symmetric spring pattern around the centralizer body. The tubing sub is slideably positioned within the central passage of the centralizer body and has opposing end portions. One of the tubing joint collars is attached to each one of the end portions of the tubing sub. The tubing joint collars and the centralizer body are jointly configured such that the tubing joint collars engage the centralizer body for constraining the tubing sub within the central passage of the centralizer body.

In another embodiment of the present invention, a tubing centralizing apparatus comprises a cylindrically shaped centralizer body, a plurality of bow springs, a cylindrically shaped tubing sub, cylindrically shaped joint collars, and a plurality of protruding members. The cylindrically shaped centralizer body has opposing end portions and a central passage extending through the opposing end portions. The centralizer body includes a plurality of apertures extending therethrough between an exterior side surface of the centralizer body and the central passage thereof. Each one of the apertures is an elongated aperture that extends lengthwise between the opposing end portions of the centralizer body. The apertures are uniformly spaced about a longitudinal axis of the central passage in a manner providing a symmetric aperture pattern in the centralizer body. The bow springs are detachably mounted on the centralizer body. A first end portion of each one of the bow springs is attached to the centralizer body adjacent a first end one of the portions thereof and a second end portion of each one of the bow springs is attached to the centralizer body adjacent a second one of the end portions thereof such that a central portion of each one of the bow springs is bowed away from the centralizer body. The bow springs are uniformly spaced about the longitudinal axis of the central passage in a manner providing a symmetric spring pattern around the centralizer body. The cylindrically shaped tubing sub is slideably positioned within the central passage of the centralizer body. A length of the tubing sub and the centralizer body are jointly configured such that each one of the opposing end portion of the tubing sub simultaneously extend beyond an adjacent one of the end portions of the centralizer body. One of the cylindrically shaped joint collars is attached to each one of the end portions of the tubing sub. The protruding members extend from an interior surface of the central passage. The protruding members and the tubing sub are jointly configured such that the protruding members approximately center the tubing sub within the central passage of the centralizer body.

These and other objects, embodiments, advantages and/or distinctions of the present invention will become readily apparent upon further review of the following specification, associated drawings and appended claims. For example, while a tubing centralizer in accordance with the present invention can be specifically configured for use with production tubing within a casing, a tubing centralizer configured in accordance with the present invention is not limited to such application. In view of the disclosures made herein, a skilled person will recognize other applications in which a tubing centralizer configured in accordance with the present invention will find use.

DETAILED DESCRIPTION OF THE DRAWING FIGURES

Figure 1:
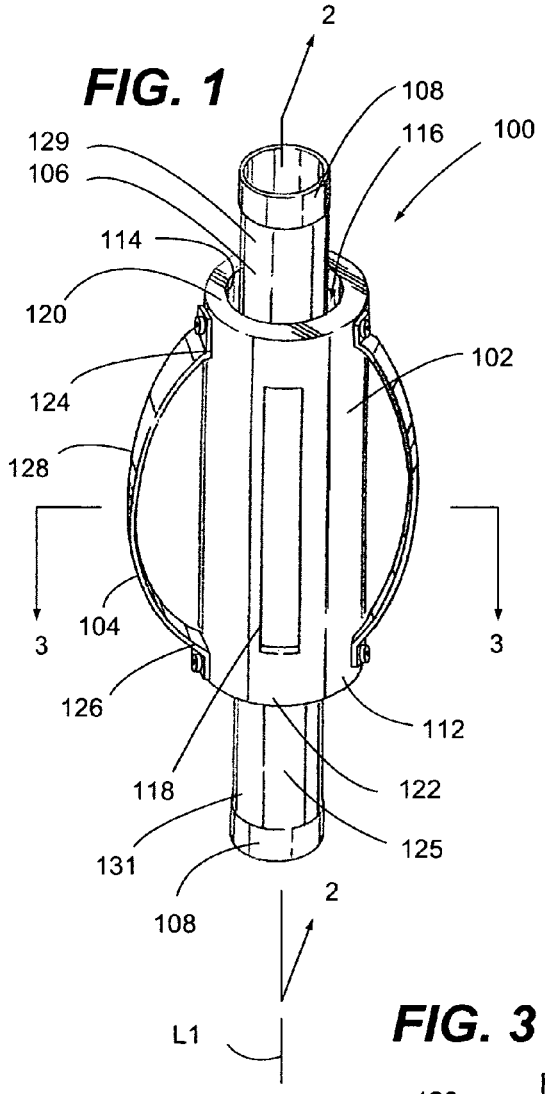
FIG. 1 is a perspective view showing a tubing centralizer apparatus configured in accordance with the present invention.
Figure 2:
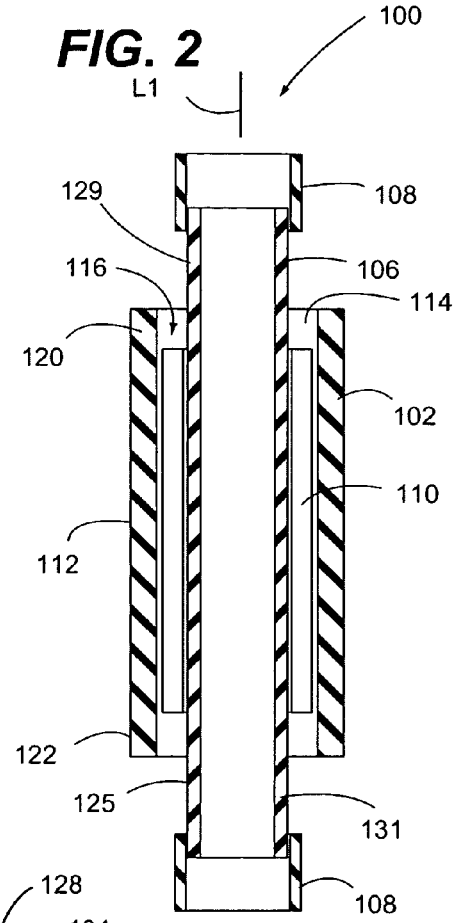
FIG. 2 is a cross-sectional view taken along the line 2-2 in FIG. 1.
Figure 3:
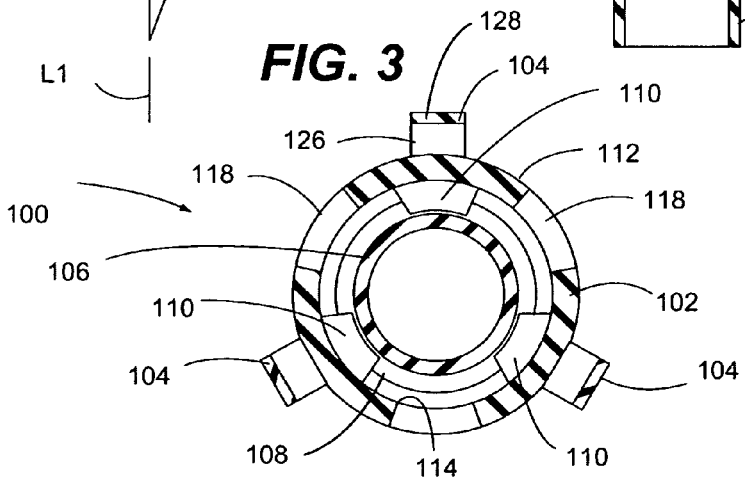
FIG. 3 is a cross-sectional view taken along the line 3-3 in FIG. 1.

FIGS. 1-3 show various aspects of a tubing centralizing apparatus 100 configured in accordance with the present invention. The tubing centralizer apparatus 100 centers an inner tubular member (e.g., production tubing) within a bore (e.g., cylindrical bore) of an outer body such as a wellbore casing. For example, on production pumping wells, the tubing centralizer apparatus 100 centers production tubing that is swinging free below a tubing anchor within a wellbore casing. In this manner, by precluding the inner tubular member from rubbing on the outer tubular member, the tubing centralizer apparatus 100 reduces, if not eliminates, the potential for perforations in the tubing and/or casing as well as reduces rod wear. Furthermore, as will be discussed below in greater detail the tubing centralizer apparatus 100 is configured for being retrievable from within the outer body (e.g., wellbore casing) and for being refurbished.

The tubing centralizer apparatus 100 includes cylindrically shaped centralizer body 102, a plurality of bow springs 104, a cylindrically shaped tubing sub 106, cylindrically shaped tubing joint collars 108, and a plurality of protruding members 110. Cylindrically shaped refers to the cross-section as viewed along a longitudinal axis of such a component. While certain components of the tubing centralizer 100 are shown as being cylindrically shaped, such components are not unnecessarily limited to being cylindrically shaped. For example, the centralizer body 102 can have other cross-sectional shapes. In fact, the centralizer body 102 can be configured such that an exterior cross-sectional shape as defined by an exterior side surface 112 is different than that of an interior cross sectional shape as defined by an interior surface 114 of a central passage 116 of the centralizer body 102.

The centralizer body 102 has opposing end portions 120, 122 and the central passage 116 extending through the opposing end portions 120, 122. A plurality of apertures 118 extend through the exterior side surface 112 of the centralizer body 102 and its central passage 116. As shown in FIG. 1, each one of the apertures 118 is an elongated aperture that extends lengthwise between the first end portion 120 and the second end portion 122 of the centralizer body 102. Preferably, the apertures 118 are uniformly spaced about a longitudinal axis L1 of the central passage 116 in a manner providing a symmetric aperture pattern in the centralizer body 102 (e.g., 3 apertures identical apertures spaced at 120 degree separation, 4 identical apertures spaced at 90 degree separation, etc).

The bow springs 104 are attached to the centralizer body 102. A first end portion 124 of each one of the bow springs 104 is attached to the centralizer body 102 adjacent its first end portion 120 and a second end portion 126 of each one of the bow springs 104 is attached to the centralizer body 102 adjacent its second portion 122 such that a central portion 128 of each one of the bow springs 104 is bowed away from the centralizer body 102. Examples of means for attaching the bow springs 104 to the centralizer body 102 include threaded fasteners, welding, or other type of robust attachment approach. Preferably, each one of the bow springs 104 is detachably attached to the centralizer body 102 in a manner allowing a replacement bow spring to be mounted on the centralizer body 102 in place of a detached one of the bow springs 104. In this manner, the bow springs 104 are serviceable items that allow the centralizer apparatus 100 to be refurbished. Preferably, the bow springs 104 are uniformly spaced about the longitudinal axis L1 of the central passage in a manner providing a symmetric spring pattern around the centralizer body 102.

The bow springs 104 are one example of a resilient members that spring bias the centralizer body 102 to a centered position within a tubular member such as, for example, a wellbore casing. It is disclosed herein that one or more of the bow springs 104 can be attached at only one end. In this manner, the central portion 128 of such a one end attached bow spring would be spring biased away from the centralizer body 102 in a cantilevered fashion.

The tubing sub 106 is slideably positioned within the central passage 116 of the centralizer body 102. A length of the tubing sub 106 and the centralizer body 102 are jointly configured such that each one of the opposing end portions 129, 131 of the tubing sub 106 simultaneously extend beyond an adjacent one of the end portions 120, 122 of the centralizer body 102. For example, as shown in FIGS. 2 and 3, a length of the tubing sub 106 can be substantially greater than a length of the centralizer body 102.

A tubing joint collar 108 is attached to each one of the end portions of the tubing sub 106. The tubing joint collars 108 can be attached to the tubing sub 106 by any number of means. Examples of such means include, but is not limited to, threads, welding, adhesive, etc. Similarly, each one of the tubing joint collars 108 is configured for having a tube or pile connected thereto in the same or different manner as the tubing sub 106.

The protruding members 110 extend from the interior surface 114 of the central passage 116. The protruding members 110 and the tubing sub 106 are jointly configured such that the protruding members 110 approximately center the tubing sub 106 within the central passage 116. Examples of means for attaching the protruding members 110 to the centralizer body 102 include threaded fasteners, welding, or other type of robust attachment approach. The protruding members 110 are uniformly and symmetrically spaced about the longitudinal axis L1 of the central passage 116. Thus, as shown, the protruding members 110 and the bow springs 104 can be positioned relative to each other such that each one of the bow springs 104 is positioned between an adjacent pair of the apertures 118.

In some embodiments of the present invention, the protruding members 110 are detachably attached to the centralizer body 102. Preferably, each one of the protruding members 110 is detachably attached to the centralizer body 102 in a manner allowing a replacement protruding member to be mounted on the centralizer body 102 in place of a detached one of the protruding members 110. In this manner, the protruding members 110 are serviceable items that allow the centralizer apparatus 100 to be refurbished. In other embodiments, the protruding members 110 and the centralizer body 102 are unitarily formed by means such as, for example, extrusion and/or machining.

As shown, the protruding members 110 and the tubing joint collar 108 are jointly configured such that sufficient displacement of the tubing sub 106 in a given direction causes one of the tubing joint collars 108 to engage one of more of the protruding members 110, thereby constraining the tubing sub 106 within the central passage 116 of the centralizer body 102. In an alternate embodiment, the tubing joint collars 108 can be sized so as to engage an adjacent end portion 120, 122 of the centralizer body 102 for constraining the tubing sub 106 within the central passage 116 of the centralizer body 102. Thus, it is disclosed that an outside dimension (e.g., diameter) of each one of the tubing joint collars 108 can be larger than an inside dimension (e.g., diameter) of the central passage 116 such that the tubing joint collars 108 engage the centralizer body 102 for constraining the tubing sub 106 within the central passage 116. In this manner, the tubing sub 106 being constrained within the centralizer body 102 results in the centralizer apparatus 100 being retrievable from a down-hole position when tubing to which it is connected is withdrawn from a downhole position.

In at least one embodiment of the present invention, the protruding members 110 are omitted. In such an embodiment, the tubing joint collars 108 can be sized so as to engage an adjacent end portion 120, 122 of the centralizer body 102 for constraining the tubing sub 106 within the central passage 116 of the centralizer body 102. Furthermore, in such an embodiment, a configuration of an exterior surface 125 of the tubing sub 106 and a configuration of the interior surface 114 of the centralizer body 102 can be jointly configured (e.g., sized and/or shaped) to approximately center the tubing sub 106 within the central passage 116 while still allowing the tubing sub 106 to be slide within the central passage 116 of the centralizer body 102. It is also disclosed herein that the protruding members 110 can be integral with the tubing sub 106 as opposed to the centralizer body 102.

In the preceding detailed description, reference has been made to the accompanying drawings that form a part hereof, and in which are shown by way of illustration specific embodiments in which the present invention may be practiced. These embodiments, and certain variants thereof, have been described in sufficient detail to enable those skilled in the art to practice embodiments of the present invention. It is to be understood that other suitable embodiments may be utilized and that logical, mechanical, chemical and electrical changes may be made without departing from the spirit or scope of such inventive disclosures. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A tubing centralizing apparatus, comprising:

a centralizer body terminating with opposing end portions and a central passage extending through the centralizer body, including said opposing end portions, wherein the centralizer body includes at least one aperture extending between an exterior side surface of the centralizer body and the central passage of the centralizer body and extending lengthwise between the opposing end portions;

a plurality of resilient members mounted on the centralizer body, wherein each one of said resilient members is in the form of an elongated strap having opposing end portions, wherein a first one of said end portions of each one of said resilient members is attached to the centralizer body adjacent one of said end portions of the centralizer body in a manner whereby a second end portion thereof extends toward the other one of said end portions of the centralizer body and wherein a central portion of each one of said resilient members is spring biased away from the centralizer body;

a tubing sub slideably positioned within the central passage of the centralizer body and having opposing end portions;

a first tubing joint collar attached to a first one of said end portions of the tubing sub, wherein the first tubing joint collar and the centralizer body are jointly configured for precluding the first tubing joint collar from passing through the central passage; and a plurality of protruding members extending from an interior surface of the central passage, wherein said protruding members and the tubing sub are jointly configured such that the protruding members approximately center the tubing sub within the central passage of the centralizer body and wherein said protruding members are symmetrically spaced about a longitudinal axis of the central passage and wherein the plurality of protruding members and the plurality of resilient members are offset such that the plurality of protruding members are located on the interior surface of the central passage of the centralizer body at a different position from where the plurality of resilient members are located on the centralizer body.

2. The tubing centralizing apparatus of claim 1, further comprising:

a second tubing joint collar attached to a second one of said end portions of the tubing sub, wherein the second tubing joint collar and the centralizer body are jointly configured for precluding the second tubing joint collar from passing through the central passage such that the first and second tubing joint collars constrain the tubing sub within the central passage of the centralizer body.

3. The production tubing centralizing apparatus of claim 1 wherein a length of the tubing sub and a length of the centralizer body are jointly configured such that each one of said opposing end portions of the tubing sub simultaneously extend beyond an adjacent one of said end portions of the centralizer body and wherein there are exactly three apertures and exactly three resilient members on the centralizer body.

4. The production tubing centralizing apparatus of claim 1 wherein the protruding members are detachably attached to the interior surface of the central passage of the centralizer body.

5. The production tubing centralizing apparatus of claim 4, further comprising:

a second tubing joint collar attached to a second one of said end portions of the tubing sub, wherein the second tubing joint collar and the centralizer body are jointly configured for precluding the second tubing joint collar from passing through the central passage such that the first and second tubing joint collars constrain the tubing sub within the central passage of the centralizer body.

6. A production tubing centralizing apparatus, comprising:

a single centralizer body terminating with opposing end portions and a central passage extending through the centralizer body, including said opposing end portions, wherein the centralizer body includes a plurality of apertures extending between an exterior side surface of the centralizer body and the central passage of the centralizer body, wherein each one of said apertures is an elongated aperture that extends lengthwise between said opposing end portions of the centralizer body and wherein said apertures are uniformly spaced about a longitudinal axis of the central passage in a manner providing a symmetric aperture pattern in the centralizer body;

a plurality of bow springs mounted on the centralizer body, wherein a first end portion of each one of said bow springs is attached to the centralizer body adjacent a first one of said end portions thereof and a second end portion of each one of said bow springs is attached to the centralizer body adjacent a second one of said end portions thereof such that a central portion of each one of said bow springs is bowed away from the centralizer body and wherein said bow springs are uniformly spaced about the longitudinal axis of the central passage in a manner providing a symmetric spring pattern around the centralizer body;

a tubing sub slideably positioned within the central passage of the centralizer body and having opposing end portions; and a tubing joint collar attached to each one of said end portions of the tubing sub, wherein said tubing joint collars and the centralizer body are jointly configured such that said tubing joint collars engage the centralizer body for constraining the tubing sub within the central passage of the centralizer body and wherein each one of the tubing joint collars is configured for having a section of production tubing for a well attached thereto.

7. The production tubing centralizing apparatus of claim 6 wherein a length of the tubing sub and a length of the centralizer body are jointly configured such that each one of said opposing end portions of the tubing sub simultaneously extend beyond an adjacent one of said end portions of the centralizer body.

8. The production tubing centralizing apparatus of claim 6 wherein each one of said bow springs is positioned between a pair of said apertures.

9. The production tubing centralizing apparatus of claim 6 wherein an outside diameter of each one of said tubing joint collars is larger than an inside diameter of the central passage of the centralizer body such that said tubing joint collars engage the centralizer body for constraining the tubing sub within the central passage for the centralizer body.

10. The production tubing centralizing apparatus of claim 6, further comprising:

a plurality of protruding members extending from an interior surface of the central passage, wherein said protruding members and the tubing sub are jointly configured such that the protruding members approximately center the tubing sub within the central passage of the centralizer body, wherein the centralizer body is cylindrically-shaped and wherein the tubing sub is cylindrically-shaped.

11. The production tubing centralizing apparatus of claim 10 wherein said protruding members are uniformly and symmetrically spaced about the longitudinal axis of the central passage.

12. The production tubing centralizing apparatus of claim 6, further comprising:

a plurality of protruding members extending from an interior surface of the central passage, wherein said protruding members and the tubing sub are jointly configured such that the protruding members approximately center the tubing sub within the central passage of the centralizer body and wherein said protruding members are uniformly and symmetrically spaced about the longitudinal axis of the central passage.

13. The production tubing centralizing apparatus of claim 12 wherein:

a length of the tubing sub and a length of the centralizer body are jointly configured such that each one of said opposing end portions of the tubing sub simultaneously extend beyond an adjacent one of said end portions of the centralizer body;

each one of said bow springs is positioned between a pair of said apertures; and an outside diameter of each one of said tubing joint collars is larger than an inside diameter of the central passage of the centralizer body such that said tubing joint collars engage the centralizer body for constraining the tubing sub within the central passage of the centralizer body.

14. A production tubing centralizing apparatus, comprising:

a cylindrically-shaped single centralizer body terminating with opposing end portions and a central passage extending through the centralizer body, including said opposing end portions, wherein the centralizer body includes a plurality of apertures extending between an exterior side surface of the centralizer body and the central passage of the centralizer body, wherein each one of said apertures is an elongated aperture that extends lengthwise between said opposing end portions of the centralizer body, and wherein said apertures are uniformly spaced about a longitudinal axis of the central passage in a manner providing a symmetric aperture pattern in the centralizer body;

a plurality of bow springs detachably mounted on the centralizer body, wherein a first end portion of each one of said bow springs is attached to the centralizer body adjacent a first one of said end portions thereof and a second end portion of each one of said bow springs is attached to the centralizer body adjacent a second one of said end portions thereof such that a central portion of each one of said bow springs is bowed away from the centralizer body and wherein said bow springs are uniformly spaced about the longitudinal axis of the central passage in a manner providing a symmetric spring pattern around the centralizer body;

a cylindrically shaped tubing sub slideably positioned within the central passage of the centralizer body;

a cylindrically-shaped tubing joint collar attached to each one of said end portions of the tubing sub; and a plurality of protruding members extending from an interior surface of the central passage, wherein said protruding members and the tubing sub are jointly configured such that the protruding members approximately center the tubing sub within the central passage of the centralizer body.

15. The production tubing centralizing apparatus of claim 14 wherein a length of the tubing sub and a length of the centralizer body are jointly configured such that each one of said opposing end portions of the tubing sub simultaneously extend beyond an adjacent one of said end portions of the centralizer body.

16. The production tubing centralizing apparatus of claim 14 wherein an outside diameter of each one of said tubing joint collars is larger than an inside diameter of the central passage of the centralizer body such that said tubing joint collars engage the centralizer body for constraining the tubing sub within the central passage of the centralizer body.

17. The production tubing centralizing apparatus of claim 14 wherein said protruding members are uniformly and symmetrically spaced about the longitudinal axis of the central passage.

18. The production tubing centralizing apparatus of claim 17 wherein:

a length of the tubing sub and the centralizer body are jointly configured such that each one of said opposing end portions of the tubing sub simultaneously extend beyond an adjacent one of said end portions of the centralizer body;

each one of said bow springs is positioned between a pair of said apertures;

an outside diameter of each one of said tubing joint collars is larger than an inside diameter of the central passage of the centralizer body such that said tubing joint collars engage the centralizer body for constraining the tubing sub within the central passage of the centralizer body; and each one of said bow springs is detachably attached to the centralizer body in a manner allowing a replacement bow spring to be mounted thereon in place of a detached one of said bow springs.

* * * * *